US006502962B1

(12) United States Patent
Menke et al.

(10) Patent No.: US 6,502,962 B1
(45) Date of Patent: Jan. 7, 2003

(54) COVER ASSEMBLY FOR A LIGHT

(75) Inventors: W. Kenneth Menke, Glendale, MO (US); W. Kenneth Menke, III, Webster Groves, MO (US)

(73) Assignee: Fire Products Company, Webster Groves, MO (US)

( * ) Notice: Subject to any disclaimer, the term of this patent is extended or adjusted under 35 U.S.C. 154(b) by 0 days.

(21) Appl. No.: 09/694,226

(22) Filed: Oct. 23, 2000

(51) Int. Cl.[7] ..... F21V 29/00

(52) U.S. Cl. ..... 362/294; 362/363; 362/374; 362/375; 362/433; 362/437; 362/439; 362/226

(58) Field of Search ..... 362/363, 374, 362/375, 294, 373, 433, 437, 439, 455, 226

(56) References Cited

U.S. PATENT DOCUMENTS

| | | | | |
|---|---|---|---|---|
| 285,784 | A | | 10/1883 | Bartlett |
| 1,015,963 | A | | 1/1912 | Kleber |
| 2,624,010 | A | | 12/1952 | Chamberlain et al. |
| 2,797,310 | A | | 6/1957 | Moore |
| 2,966,605 | A | | 12/1960 | Harris et al. |
| 3,134,920 | A | | 5/1964 | Van de Weijer et al. |
| 3,188,513 | A | | 6/1965 | Hansler |
| 3,253,137 | A | | 5/1966 | Richter, III |
| 3,473,015 | A | | 10/1969 | Haas et al. |
| 3,531,677 | A | | 9/1970 | Loughridge |
| 3,609,348 | A | * | 9/1971 | Marasco ..... 240/102 R |
| 3,731,612 | A | | 5/1973 | Schmidt et al. |
| 4,074,165 | A | | 2/1978 | Moriyama |
| 4,337,414 | A | * | 6/1982 | Young ..... 315/56 |
| 4,375,607 | A | * | 3/1983 | Morton et al. ..... 315/56 |
| 4,393,331 | A | | 7/1983 | Dobrusskin et al. |
| 4,479,173 | A | | 10/1984 | Rumpakis |
| 4,503,360 | A | * | 3/1985 | Bedel ..... 315/112 |
| 4,717,852 | A | | 1/1988 | Dobrusskin et al. |
| 4,982,313 | A | * | 1/1991 | Lupien ..... 362/368 |
| 5,050,055 | A | | 9/1991 | Lindsay et al. |
| 5,083,251 | A | | 1/1992 | Parker |
| 5,184,890 | A | | 2/1993 | Chen et al. |
| 5,195,815 | A | | 3/1993 | Watanabe et al. |
| 5,243,501 | A | | 9/1993 | Makita et al. |
| 5,357,407 | A | | 10/1994 | Woods |
| 5,457,616 | A | | 10/1995 | Grigorescu et al. |
| 5,488,546 | A | | 1/1996 | Sato et al. |
| 5,513,086 | A | | 4/1996 | Ho |
| 5,537,301 | A | * | 7/1996 | Martich ..... 362/218 |
| 5,576,591 | A | | 11/1996 | Block et al. |
| 5,854,535 | A | | 12/1998 | Hohlfeld et al. |
| 5,918,966 | A | | 7/1999 | Arnold |
| 5,971,575 | A | | 10/1999 | Matubara |
| 6,048,082 | A | | 4/2000 | Washimoto |

* cited by examiner

*Primary Examiner*—Thomas M. Sember
*Assistant Examiner*—Jacob Y. Choi
(74) *Attorney, Agent, or Firm*—Thompson Coburn LLP

(57) ABSTRACT

A removable, reusable cover assembly for a light assembly has a light filtering cover with an interior that surrounds a lamp of the light assembly and a connector that attaches to the light assembly. The cover assembly has first and second vent holes that communicate with the interior of the cover. During energization of the lamp, the air in the interior of the cover is heated and escapes through the first vent hole. Cooling air is drawn through the second vent hole into the interior of the cover to cool the lamp.

29 Claims, 3 Drawing Sheets

COVER ASSEMBLY FOR A LIGHT

BACKGROUND OF THE INVENTION (1) Field of the Invention

The present invention pertains to a protective cover for a lamp and in particular to a reusable color filter that can be removably attached to the mounting assembly of a halogen lamp used in an emergency warning light to protect the lamp and change the color of the light emitted by the lamp while providing a flow of air to cool the lamp.

(2) Description of the Related Art

From 1915 to 1950, virtually all emergency warning lights were devices that incorporated an incandescent lamp and a parabolic reflector, both mounted behind an essentially flat color glass filter. The reflector directed light emitted from the lamp through the colored glass filter. The flashing of the light was produced by interrupting the current to the lamp. Although these devices were simple and inexpensive, they were considered to have two serious deficiencies.

First, the emergency warning lights were highly directional and projected a flash of warning light in only a fraction of the perimeter around the vehicle on which the warning light was mounted. Second, because it was necessary to reheat the lamp filament at the start of each flash, the warning lights were very inefficient.

In the late 1940's, the rotating beacon warning light was developed. The rotating beacon also used an incandescent lamp and a parabolic reflector positioned behind the lamp. However, flashes of the lamp were obtained by using a small motor to rotate the lamp and reflector together inside a colored, circular lens. Although the rotating beacon warning light eliminated the previous directional deficiencies of warning lights, using the same single light source as the previous directional warning light (typically a 30–60 watt bulb), the 360° signal emanating from the rotating beacon was not nearly as intense as that generated by the older directional devices that concentrated their energy in an arc of about 30°.

To overcome the shortcomings of the rotating beacon signal light, a sealed beam spotlight lamp was used in place of the bulb and reflector. By using as many as 4 sealed beam spotlight lamps mounted on a common turntable, acceptable levels of warning light flashes were achieved in all directions around the vehicle on which the rotating sealed beam spotlight lamp warning light was mounted.

Whether a directional warning light, a single lamp rotating or multiple lamps rotating warning light, all warning lights typically used a colored lens to produce a light signal of a single color. For a few special applications, two lenses were cut in half and glued together to form a split lens that, for example, flashed red to the front and yellow to the rear.

After the introduction of the multiple sealed beam spotlight lamp beacon, they were modified by putting colored faces on the spotlight lamps and enclosing the multiple spotlight lamps inside a clear lens. Combinations of red and clear colored faces on the spotlight lamps were also used. However, the sealed beam spotlight lamps were disadvantaged in that they were expensive and relatively heavy. They required large and expensive motors and turntables to support and rotate the spotlight lamps. In addition, it was noticed that in those signal lights employing colored faces on the spotlight lamps that the colors were not very heat resistant and would burn away.

In the mid-1970's, the lightbar emergency warning light was introduced. Basically, the lightbar was constructed of a series of rotating spotlight beacons mounted in a row under rectangular lenses. However, it was soon discovered by police departments that their cars equipped with lightbars using colored lenses could be seen for miles, even when the warning lights were off. Cars using lightbars with clear lenses over colored sealed beam lamps were equally effective with their lights on, but were much less visible with their lights off.

Halogen headlights using replaceable halogen capsules were introduced in the 1980's and soon ended the use of conventional sealed beam lamps for headlights. By using the same inexpensive halogen capsule, warning light manufacturers realized they could produce a less expensive but higher performance product. However, the halogen lamp could not be used with the conventional clear lenses. The halogen lamps burn very hot and required envelopes of special glass and it was found to be impractical to color the glass as was done for sealed beam spotlight lamps.

To overcome this problem, several filter designs were developed, such as that disclosed in U.S. Pat. No. 4,543,622. The filter design of this patent was successful when used with 360° rotating light elements and is still widely used. With rotating signal light elements, the common method for obtaining color signals from a halogen lamp under a clear lens is to attach a filter to the reflector of the signal light element so that it rotates with the reflector. However, when this is attempted with an oscillating signal light having an oscillating reflector of the type described in U.S. Pat. No. 5,385,062; U.S. Pat. No. 5,697,691; U.S. Pat. No. 5,842,768 and U.S. Pat. No. 5,676,447, the filter adds substantial weight to the light element and changes the arc of coverage of the warning light signal.

Colored halogen warning signal lamps have been designed that have a close fitting colored glass tube positioned over the halogen bulb. One end of the colored glass tube is closed and the other end is open. A standard halogen lamp is inserted into the tube and a high temperature cement is used to permanently bond the open end of the colored glass filter tube to the metallic base of the halogen lamp. However, the close fitting glass tube appreciably increases the operating temperature of the halogen lamp. These lamps with colored tubes were primarily designed for use in a current interrupted flashing warning light with less than a 50% duty cycle. It was found when these lamps were used in a 100% duty cycle device, such as a rotating or oscillating beacon, the halogen lamp life was less than half of that obtained when the halogen lamp is operated without the colored filter. The addition of the close fitting, closed filter increases the internal temperature of the halogen bulb and leads to its rapid failure. In addition, the manufacture of a halogen lamp with a permanent color filter secured over the lamp bulb significantly increases the price of the halogen lamp alone. With less than half of the useful life of the halogen lamp at a significant increase in cost over the halogen lamp, the use of the halogen lamp with the colored filtered tube was considered too impractical for use in continuous duty warning lights.

What is needed to overcome the shortcomings experienced in providing color to a signal light produced by a halogen lamp in an oscillating or rotating signal light assembly under a clear lens is a high temperature, colored filter that does not affect the performance of either the halogen lamp or the signal light assembly. The filter should be easily removable from the standard halogen lamp to permit reuse whenever the halogen lamp is replaced.

SUMMARY OF THE INVENTION

The present invention overcomes the disadvantages of the prior art by providing a reusable cover assembly that attaches to a standard halogen lamp or any other high temperature light source having a socket and a lamp in the socket. The cover assembly preferably changes a color of light emitted by the lamp while providing a sufficient flow of cooling air through the reusable cover assembly to minimize any reduction in the operating life of the lamp. The reusable cover assembly of the invention does not impede the operation of the oscillating or rotating element or require expensive segmented lenses around the oscillating element. The cover assembly not only filters light emitted by the lamp, but also functions as a protective cover over the lamp that protects the lamp from accidental contact.

The reusable cover assembly of the present invention includes a metallic connector that attaches to the lamp or lamp socket of a signal light assembly and a cover in the form of a high temperature colored filter that surrounds the lamp. The connector easily snaps over a standard halogen lamp and lamp socket and holds the reusable cover assembly securely to the signal light assembly. The connector permits easy removal of the cover assembly from the signal light assembly when the lamp burns out and allows easy installation of the reusable cover assembly over a replacement lamp.

The connector of the cover assembly has a filter or cover mounting portion that is connected to a lamp or lamp socket mounting portion. The lamp or lamp socket mounting portion attaches to the lamp or lamp socket of the signal light assembly and the cover mounting portion supports the colored filter over the signal light lamp. The connection between the filter or cover mounting portion of the connector and the colored filter or cover is flexible to compensate for the differences in the coefficient of thermal expansion between the filter and the filter mounting portion of the connector. Because the connection between the connector and filter is subjected to a wide range of temperatures as the lamp is switched from a de-energized state to a prolonged operating state, the flexible connection between the connector and filter ensures the integrity of the cover assembly.

The metallic connector has an arrangement of vent openings that permit entry of cooling air into the cover assembly and between the colored filter lamp cover and the lamp. The filter cover is provided with a top vent hole to permit exiting of air heated by the lamp from inside the cover. Cooling air enters through the arrangement of vent openings in the cover assembly, flows between an interior space between the lamp and the filter cover thereby cooling the lamp to keep it operating properly for a longer period of time, and then escapes through the top vent hole of the filter cover. The top of the colored filter cover or the area of the cover around the top vent hole is preferably rounded and/or tapered to minimize the passage of unfiltered white light from the lamp through the vent hole.

The reusable cover assembly of the present invention provides colored light for a warning signal light yet does not appreciably affect the performance of the halogen lamp or the oscillation means by which the signal light assembly is rotated or oscillated through an arc. The reusable cover assembly of the invention is easily removable from the lamp or lamp socket of the standard signal light assembly and permits reuse whenever the halogen lamp is replaced. In addition to providing a colored filter for the halogen lamp, the cover assembly also protects the lamp from accidental contact.

BRIEF DESCRIPTION OF THE DRAWINGS

Further objects and features of the invention are revealed in the following detailed description of the preferred embodiment of the invention and in the drawing figures wherein.

Corresponding reference numerals indicate corresponding parts through the several views of the drawings.

DETAILED DESCRIPTION OF THE PREFERRED EMBODIMENT

Figure 1:
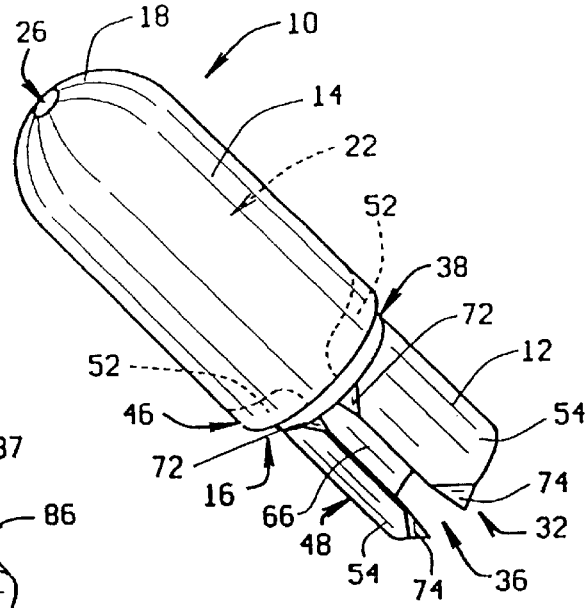
FIG. 1 is a front perspective view of a cover assembly of the present invention.
Figure 4:
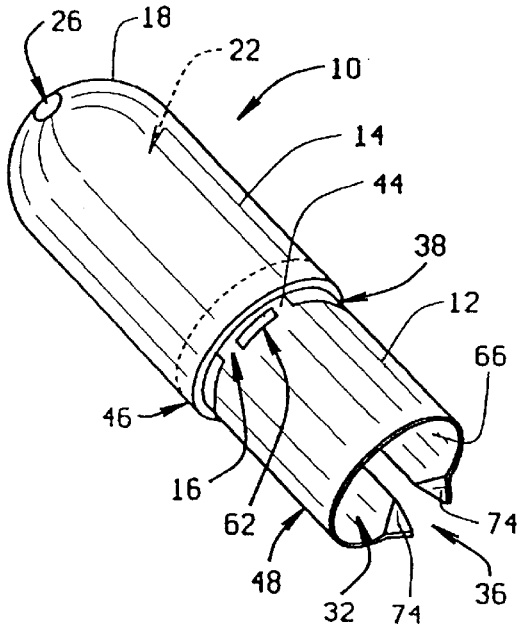
FIG. 4 is a rear perspective view of the cover assembly of FIG. 1.
Figure 5A:
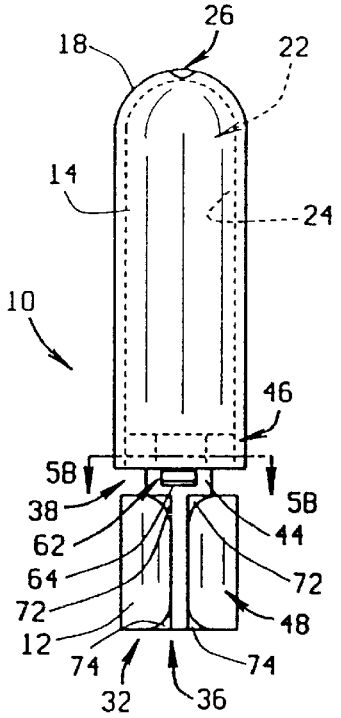
FIG. 5A is front elevation view of the cover assembly of FIG. 1.
Figure 5B:
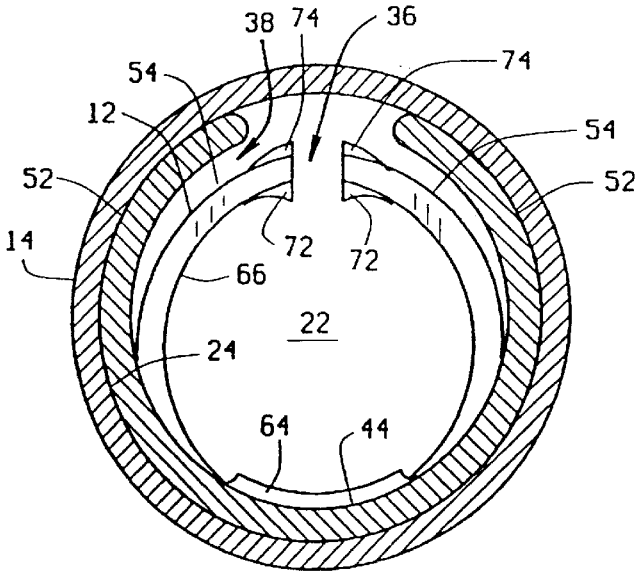
FIG. 5B is a top cross-sectional view of the cover assembly of FIG. 1 along lines 5B—5B of FIG. 5A.
Figure 6:
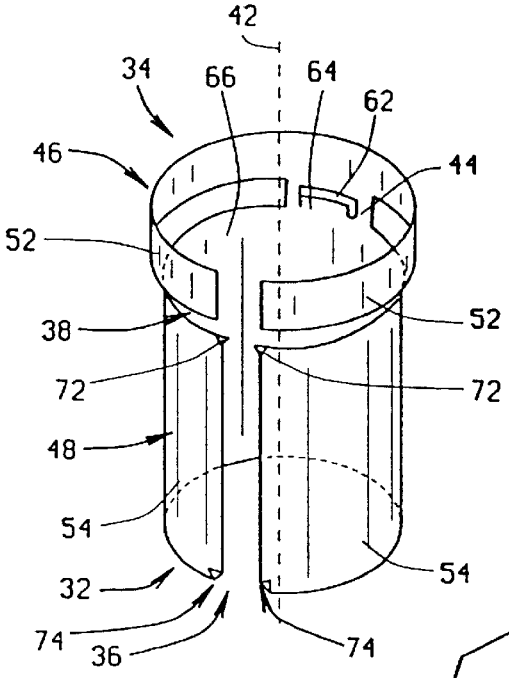
FIG. 6 is a perspective view of the connector of the cover assembly.
Figure 7:
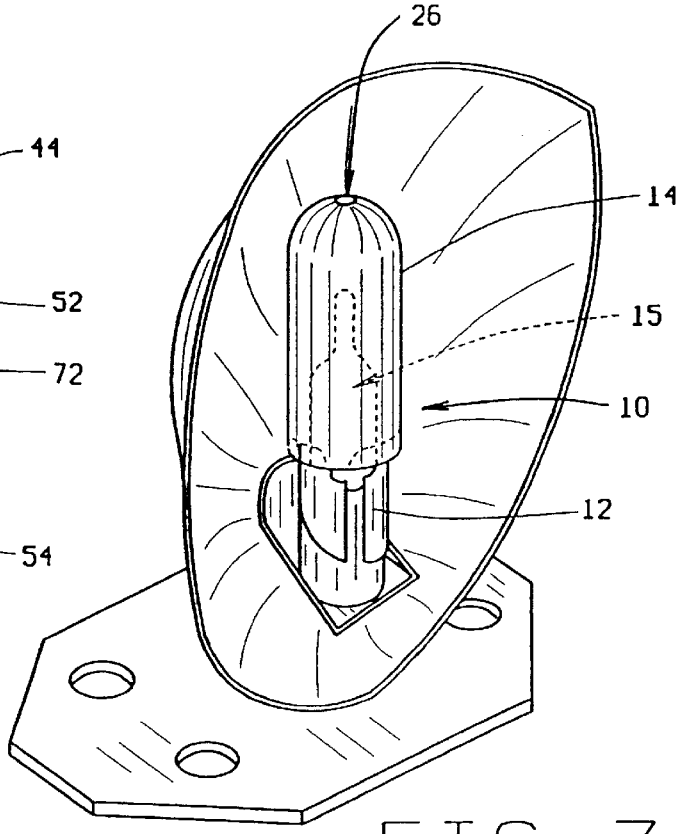
FIG. 7 is a perspective view of the cover assembly and signal light assembly of FIG. 3A installed on an oscillating or rotating element.

FIGS. 1 and 4 show the cover assembly 10 of the invention with FIG. 1 showing one side of the cover assembly and FIG. 4 showing the opposite side. The cover assembly is basically comprised of a signal light connector 12 and a lamp cover 14. In the preferred embodiment, the signal light connector 12 has a cylindrical shape as shown in the drawing figures that enables it to be mounted over the cylindrical exterior surface of a conventional signal light assembly 15. However, when the cover assembly 10 is intended to be used with a signal light assembly having an exterior configuration that is other than cylindrical, the shape of the signal light connector 12 will change to enable it to be mounted over the particular signal light assembly in the manner to be described. In the preferred embodiment, the signal light connector 12 is constructed of metal that gives the connector a resiliency. However, other similar types of resilient materials may also be employed.

The lamp cover 14 in the preferred embodiment is constructed of glass that is color tinted. This enables the lamp cover 14 to function as a colored filter for the halogen lamp or other high temperature bulb of the signal light assembly on which the cover assembly is used. However, the lamp cover 14 will also protect the halogen lamp from inadvertent contact. If the cover 14 is to function as only a protection for the halogen lamp or other high temperature lamp with which the cover assembly is used, it is not necessary that it be constructed of a color tinted glass and could be constructed of a clear glass. Still further, the lamp cover 14 could function as both a protector for a high temperature lamp on which the cover assembly is used and also function as a means for directing a beam of light from the lamp through a hole in the cover to be described. When the lamp cover 14 is used for this particular function, it could be constructed of opaque glass or other opaque materials such as ceramics. In the drawing figures, the lamp cover 14 is shown as having a general cylindrical configuration. However, the configuration of the lamp cover 14 will be determined by the configuration of the high temperature lamp with which it is used and could have other configurations, for example spherical.

In the preferred embodiment, the lamp cover 14 functions as both a color filter for a halogen or other high temperature lamp and as a protective cover for the lamp. The lamp cover 14 has a cylindrical configuration along most of its length with a circular lamp opening 16 at one end of its length and a rounded end 18 at the opposite end of its length. The cylindrical configuration of the lamp cover 14 is determined to be sufficiently large to provide the lamp cover 14 with an interior volume 22 that will easily accommodate the lamp of the signal light assembly 15 with which the cover assembly is to be used and provide a spacing between the exterior surface of the lamp and the interior surface 24 of the lamp cover 14 when the cover is positioned over the lamp. Centered in the rounded end 18 of the filter cover is a first vent hole 26. The vent hole 26 is dimensioned significantly smaller than the lamp opening 16 of the cover. The reduced size of the vent hole 26 is provided to reduce or minimize the passage of any unfiltered light from the lamp with which the cover assembly is used through the vent hole. However, the vent hole 26 is still dimensioned sufficiently large to allow air heated in the cover interior volume 22 to easily escape from the interior through the vent hole 26.

The signal light connector 12 has a cylindrical length with a socket opening 32 at one end a lamp opening 34 at the opposite end. An axial slot 36 is formed through the connector between its socket opening end 32 and the lamp opening end 34. The slot 36 is traversed by a circumferential cut 38 formed in the connector. The circumferential cut 38 extends almost entirely through the signal light connector 12 and extends from the axial slot 36 beyond a center axis 42 of the connector and stops short of entirely passing through the connector leaving a web 44 on the connector opposite the axial slot 36. The cut 38 functions as second vent hole or vent opening of the cover assembly 10 as will be explained. The cut 38 separates the signal light connector 12 into two sections, a cover mounting section 46 and a socket mounting section 48. As can be seen in the drawing figures, the socket mounting section 48 has a larger axial length than the cover mounting section 46. The position of the cut 38 and the axial slot 36 form the cover mounting section 46 of the signal light connector 12 as two resilient, arcuate fingers 52. The circumferential cut 38 and the axial slot 36 also form the signal light connector 12 with a pair of resilient, arcuate base members 54. The fingers 52 are enlarged radially outwardly from the connector center axis 42 so that an interior diameter of the arcuate fingers 52 is slightly larger than the interior diameter of the arcuate base members 54. The arcuate fingers 52 are deformed radially outwardly so that an exterior diameter defined by the arcuate fingers is slightly larger than an interior diameter of the lamp opening 16 of the lamp cover 14.

A third venting opening or aperture 62 is formed in the web 44 of the signal light connector 12. This third vent aperture 62 is formed by cutting a small, inverted U-shaped cut in the web 44 and bending the tab formed by the cut radially inwardly from the web 44. This forms the vent aperture 62 in the web 44 and also forms a web protrusion 64 on the interior surface 66 of the signal light connector 12.

The circumferential cut 38 and the axial slot 36 in the signal light connector 12 also form the arcuate base members 54 with spaced distal ends having mutually opposed cut corners 72 adjacent the circumferential cut 38 and socket corners 74 adjacent the signal light connector socket opening 32. The cut corners 72 are bent slightly, radially inwardly. The cut corners 72, together with the web protrusion 64 accurately position the cover assembly 10 on the lamp or lamp socket of the signal light assembly 15 as will be explained. The socket corners 74 are bent slightly, radially outwardly. This configuration of the socket corners 74 facilitates the attachment of the socket connector 12 on the signal light assembly 15.

The lamp cover 14 is assembled on the signal light connector 12 by first resiliently biasing the arcuate fingers 52 of the cover mounting section 46 radially inwardly toward each other. The displaced fingers 52 are then inserted into the lamp opening 16 of the filter cover 14. The radially inwardly biasing force on the arcuate fingers 52 is then released, allowing them to expand radially outwardly and engage with the interior surface 22 of the filter cover adjacent the cover lamp opening 16. To securely hold the bulb filter cover 14 to the signal light connector 12, a high temperature elastomer, such as a silicone rubber, can be applied to the connection between the lamp cover 14 and the arcuate fingers 52 of the signal light connector 12. By employing a high temperature elastomer, the lamp cover 14 and, in particular, the portion of the cover adjacent the lamp opening 16 is free to expand and contract when subjected to the heat of a signal light lamp independently of the expansion and contraction of the arcuate fingers 52 also subjected to the lamp heat. The high temperature elastomer compensates for any difference in the expansion and contraction of the lamp cover 14 and the arcuate fingers 52 and maintains a secure connection between the lamp cover 14 and the signal light connector 12.

The cover assembly 10 is removably attached to the signal light assembly 15 by inserting the signal light connector 12 over the signal light assembly 15 with the lamp 84 passing through the signal light connector socket opening 32 and the lamp opening 16 of the lamp cover 14. The socket corners 74 facilitate in the passage of the signal light connector socket opening 32 over the signal light assembly exterior surface 86.

Figure 2A:
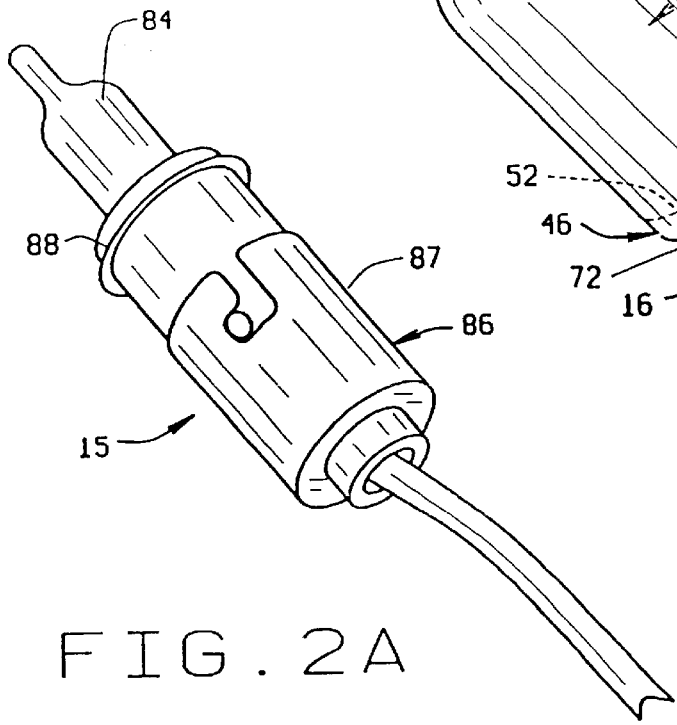
FIG. 2A is a front perspective view of a lamp and lamp socket of a signal light assembly on which the cover assembly of FIG. 1 is used.

FIG. 2A show one type of signal light assembly 15 that is comprised of a lamp 84 mounted in a lamp socket 87. In this embodiment of the signal light assembly, the lamp 84 has a protruding rim 88 on its base. In attaching the cover assembly to the signal light assembly 15 of FIG. 2A, the arcuate base members 54 of the signal light connector 12 pass over the lamp 84 and the exterior surface of the lamp socket 87 until the two cut corners 72 of the base members snap over the protruding rim 88 on the lamp 84 and the web protrusion 64 of the connector comes into contact with a top edge of the protruding rim 88, thereby removably attaching the lamp cover 14 on the signal lamp assembly 15.

Figure 2B:
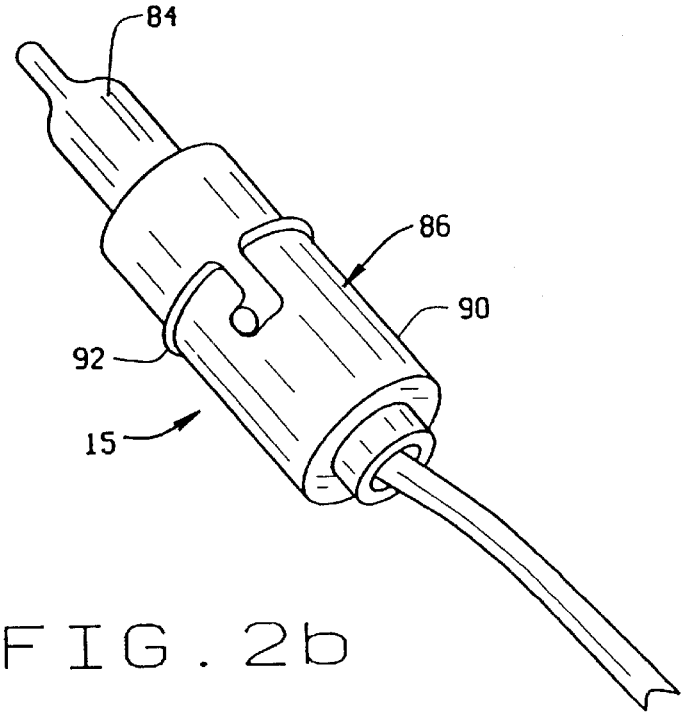
FIG. 2B is a front perspective view of an alternative embodiment of a lamp and lamp socket of a signal light assembly on which the cover assembly of FIG. 1 is used.
Figure 3A:
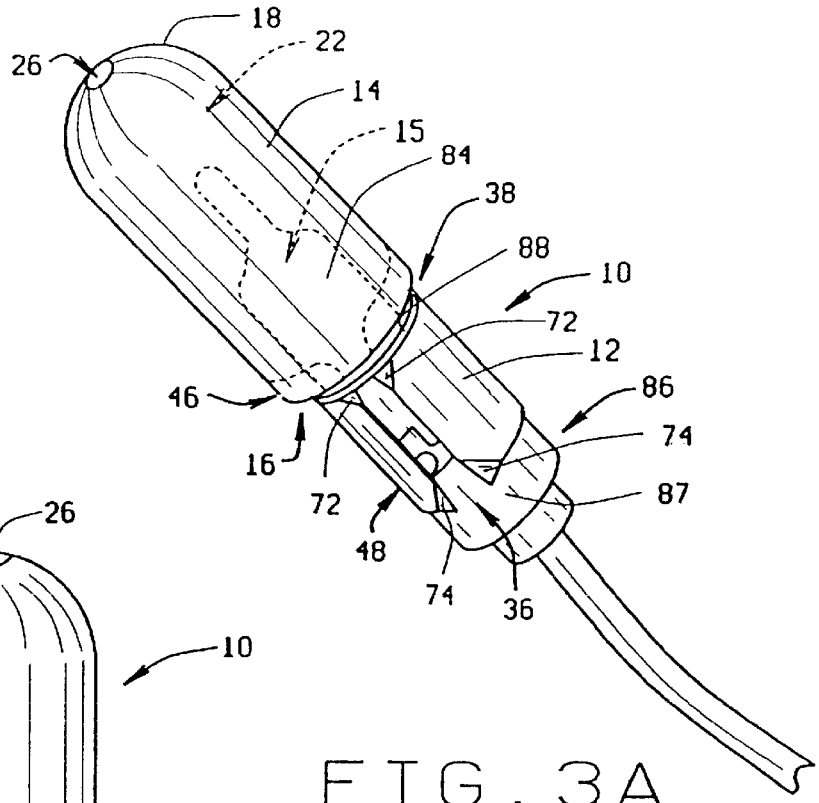
FIG. 3A is a front perspective view of the cover assembly of FIG. 1 installed on the lamp and lamp socket of the signal light assembly of FIG. 2A or FIG. 2B.
Figure 3B:
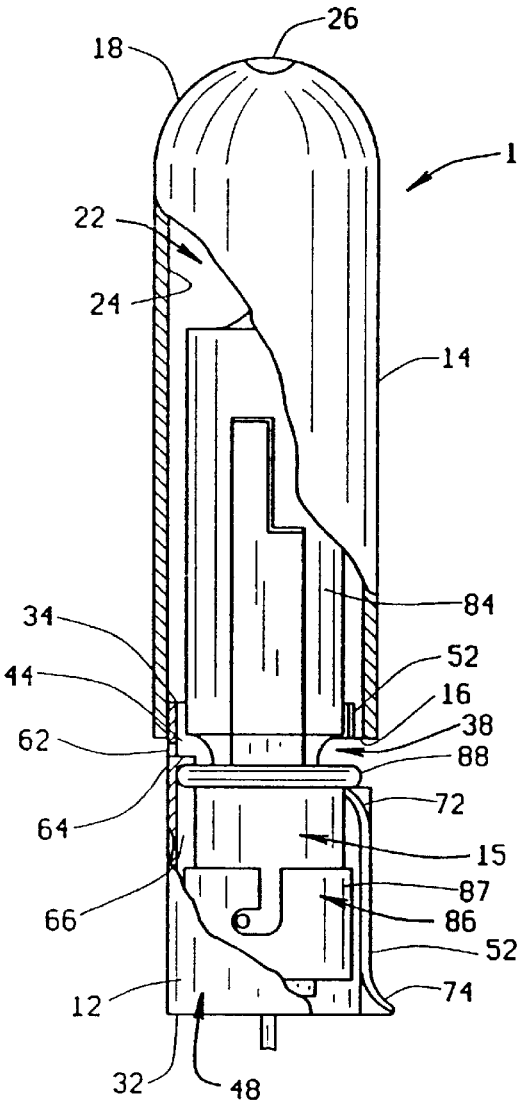
FIG. 3B is a partial sectional view of the cover assembly and the signal light assembly of FIG. 3A.

FIG. 2B shows a slightly different type of signal light assembly that is comprised of a lamp 84 mounted in- a lamp socket 90, but in this embodiment of the signal light assembly, the socket 90 has a protruding rim 92. In attaching the cover assembly to the signal light assembly 15 of FIG. 2B, the arcuate base members 54 of the signal light connector 12 pass over the lamp 84 and the exterior surface of the lamp socket 90 until the two cut corners 72 of the base members snap over the protruding rim 92 on the lamp socket 90 and the web protrusion 64 of the connector comes into contact with a top edge of the protruding rim 92, thereby removably attaching the lamp cover 14 on the signal lamp assembly 15.

The web protrusion 64 limits the downward movement of the cover assembly 10 on the signal light assembly 15 while the cut corners 72 prevent upward movement of the cover assembly 10 on the signal light assembly 15. The web protrusion 64 and the cut corners 72 act on opposite sides of the protruding rim to prevent the cover assembly 10 from inadvertently separating from the signal light assembly 15 during operation. However, pulling upward with modest force allows the cover assembly 10 to be removed from the signal light assembly 15, for instance, as would be necessary when changing the lamp 84. The lamp 84 has a bayonet style base that allows the lamp 84 to be removed from the socket by rotating the lamp 84 in the socket and pulling upward.

With the cover assembly 10 positioned on the signal light assembly 15, operation of the lamp 84 will generate heat in the interior volume 22 of the lamp cover 14. With the cover assembly 10 and signal light assembly 15 positioned in an upward orientation, the heated air in the lamp cover 14 will rise and pass through the vent opening 26 at the top of the lamp cover 14. This will draw cooling air through the second vent opening provided by the circumferential cut 38 and the third vent opening provided by the vent aperture 62 of the web into the interior volume 22 of the filter cover, thus cooling the lamp 84. In this manner, the cover assembly 10 provides a color tint to the halogen lamp 84 or other high temperature lamp 84 of the signal light assembly 15 without appreciably increasing its operating temperature due to the venting of the lamp cover 14. The lamp cover 14 also functions to prevent inadvertent contact with the lamp 84 of the signal light assembly 15.

While the present invention has been described by reference to a specific embodiment, it should be understood that modifications and variations of the invention may be constructed without departing form the scope of the invention defined in the following claims.

What is claimed is:

1. A cover assembly for a light having a socket with an exterior surface and an interior and a lamp in the socket interior, the cover assembly comprising:

a connector having a length with a lamp opening at one end and a socket opening at an opposite end of the connector length, the connector having means for removably attaching the connector to the socket exterior surface, the socket opening being dimensioned to pass over the lamp in the light socket in removably attaching the connector to the socket exterior;

a cover having a length with a lamp opening at one end and a first vent opening at an opposite end of the cover length, the cover being attached to the connector at the cover lamp opening and the connector lamp opening, the cover having an interior volume dimensioned to receive the lamp therein when the connector is removably attached to the exterior surface of the light socket; and a second vent opening in the cover assembly intermediate and spaced from the connector socket opening and the cover first vent opening and providing a flow path for cooling air through the second vent opening, the cover interior volume, and the first vent opening.

2. The cover assembly of claim 1, wherein:

the second vent opening includes a cut in the connector that partitions the connector into a socket mounting portion adjacent the connector socket opening and a cover mounting portion adjacent the connector lamp opening.

3. The cover assembly of claim 2, wherein:

the cut extends partially through the connector thereby forming a web section between the socket mounting portion and the cover mounting portion.

4. The cover assembly of claim 3, wherein:

a third vent opening is formed in the web section.

5. A cover assembly for a light having a socket with an exterior surface and an interior and a lamp in the socket interior, the cover assembly comprising:

a connector having a length with a lamp opening at one end and a socket opening at an opposite end of the connector length, the connector having means for removably attaching the connector to the socket exterior surface;

a cover having a length with a lamp opening at one end and a first vent opening at an opposite end of the cover length, the cover being attached to the connector at the cover lamp opening and the connector lamp opening, the cover having an interior volume dimensioned to receive the lamp therein when the connector is removably attached to the exterior surface of the light socket; and a second vent opening in the cover assembly intermediate and spaced from the connector socket opening and the cover first vent opening and providing a flow path for cooling air through the second vent opening, the cover interior volume, and the first vent opening; and the second vent opening includes a cut in the connector that partitions the connector into a socket mounting portion adjacent the connector socket opening and a cover mounting portion adjacent the connector lamp opening;

the cut extends partially through the connector thereby forming a web section between the socket mounting portion and the cover mounting portion;

a third vent opening is formed in the web section;

the third vent opening is defined by an aperture in the web, the aperture has an inwardly turned edge that engages the light when the cover assembly is installed on the light.

6. The cover assembly of claim 1 for a light having a projecting rim, the cover assembly comprising:

a protrusion on the connector projecting toward the bulb opening and an inturned corner on the connector projecting toward the bulb opening, the protrusion and the inturned corner being positioned relative to each other where the inturned corner will snap over the rim and engage one side of the rim with the protrusion engaging an opposite side of the rim as the connector is attached to the light to removably attach the connector to the light.

7. The cover assembly of claim 6, wherein:

the projecting rim is formed integral with the socket.

8. The cover assembly of claim 6, wherein:

the projecting rim is formed integral with the lamp.

9. The cover assembly of claim 2, wherein:

the connector has a slot along its length that intersects the cut, the socket opening and the lamp opening.

10. The cover assembly of claim 9, wherein:

the connector is constructed of a resilient material and the slot enables the socket mounting portion to resiliently expand and contract where the socket mounting portion resiliently expands when the connector is attached to the light and thereby removably attaches the cover assembly to the light.

11. The cover assembly of claim 9, wherein:

the connector is constructed of a resilient material and the slot enables the cover mounting portion to resiliently expand and contract independently of the socket mounting portion.

12. A cover assembly for a light having a socket and a lamp in the socket, the cover assembly comprising:

a connector having a length with a lamp opening at one end and a socket opening at an opposite end of the connector length, the connector being attachable to the light at the socket opening;

a cover having a length with a lamp opening at one end and a first vent opening at an opposite end of the cover length, the cover being attached to the connector at the cover lamp opening and the connector lamp opening, the cover having an interior volume dimensioned to receive the lamp therein;

a second vent opening in the cover assembly intermediate and spaced from the connector socket opening and the cover first vent opening and providing a flow path for cooling air through the second vent opening, the cover interior volume, and the first vent opening;

the second vent opening includes a cut in the connector that partitions the connector into a socket mounting portion adjacent the connector socket opening and a cover mounting portion adjacent the connector lamp opening; and the connector has a slot along its length that intersects the cut, the socket opening and the lamp opening; and the cover mounting portion is positioned in the interior volume of the cover and is resiliently contacted by the cover and exerts a force against the cover.

13. The cover assembly of claim 12, wherein:

the cover is secured to the cover mounting portion by a high temperature elastomer.

14. The cover assembly of claim 1, wherein:

the cover is a color filter.

15. A cover assembly for a light having a socket and a lamp in the socket, the cover assembly comprising:

a cover having a length and an interior volume dimensioned to receive the lamp therein;

a connector having a length with a slot extending along its length and a partial cut in the connector traversing the slot and the connector length and dividing the connector into a cover mounting portion and a socket mounting portion with a web spanning the cut and connecting the cover mounting portion and the socket mounting portion, the cover mounting portion being connected to the cover and the socket mounting portion having means for removably attaching the socket mounting portion to at least a portion of an outside surface of the light socket; and the connector being constructed of a resilient, flexible material with the cover mounting portion being urged against the cover to position the cover about the lamp and the socket mounting portion being urged against the socket in removably attaching the socket mounting portion to the portion of the outside surface of the light socket.

16. The cover assembly of claim 15, wherein:

the cover is a color filter.

17. The cover assembly of claim 15, wherein:

the connector is cylindrical and has a center axis and the partial cut is positioned in a plane that is intersected by the center axis.

18. A cover assembly for a light having a socket and a lamp in the socket, the cover assembly comprising:

a cover having a length and an interior volume dimensioned to receive the lamp therein;

a connector having a length with a partial cut in the connector traversing the connector length and dividing the connector into a cover mounting portion and a socket mounting portion with a web spanning the cut and connecting the cover mounting portion and the socket mounting portion, the cover mounting portion being connected to the cover and the socket mounting portion having means for removably attaching the socket mounting portion to at least a portion of an outside surface of the light socket;

the connector being constructed of a resilient, flexible material whereby the web section enables the cover mounting portion and the socket mounting portion to resiliently flex independently of each other;

the connector is cylindrical and has a center axis and the partial cut is positioned in a plane that is intersected by the center axis; and the connector has an axial slot along its length that forms the cover mounting portion as a pair of resilient, arcuate fingers and forms the socket mounting portion as a pair of resilient, arcuate base members.

19. The cover assembly of claim 18, wherein:

the cover has an interior surface and the pair of fingers are resiliently urged against the cover interior surface.

20. The cover assembly of claim 18, wherein:

the pair of base members are resiliently urged around the light when the cover assembly is removably attached to the light.

21. The cover assembly of claim 18, wherein:

the pair of fingers are held to the cover by a high temperature elastomer.

22. The cover assembly of claim 15 for a light having a projecting rim, the cover assembly comprising:

a protrusion on the connector projecting toward the lamp opening and an inturned corner on the connector projecting toward the lamp opening, the protrusion and the inturned corner being positioned relative to each other where the inturned corner will snap over the rim and engage one side of the rim with the protrusion engaging an opposite side of the rim as the connector is attached to the light to removably attach the connector to the light.

23. The cover assembly of claim 22, wherein:

the projecting rim is formed integral with the socket.

24. The cover assembly of claim 22, wherein:

the projecting rim is formed integral with the lamp.

25. A cover assembly for a light having a socket and a lamp in the socket, the cover assembly comprising:

a connector having a length with a socket opening at one end and a lamp opening at an opposite end of the connector length, the connector having means for removably attaching the connector to at least a portion of an outside surface of the light socket at the socket opening;

a light filter cover having a length with a lamp opening at one end and a vent opening at an opposite end of the light filter cover length, the light filter cover being attached to the connector at the cover lamp opening and the connector lamp opening, the light filter cover having an interior volume for receiving the lamp therein, and the vent opening being smaller than the cover lamp opening thereby minimizing a portion of light emitted from the light filter cover that passes through the vent opening; and the lamp opening of the light filter cover is dimensioned larger than the lamp to enable the lamp to pass therethrough in removably attaching the connector to the portion of the outside surface of the light socket and the vent opening is dimensioned smaller than the lamp.

26. The cover of claim 25, wherein:

the lamp opening of the light filter cover is larger than the socket opening of the connector.

27. The cover assembly of claim 25 for a light having a projecting rim adjacent the lamp in the socket, the cover assembly comprising:

a protrusion on the connector projecting toward the lamp opening and an inturned corner on the connector projecting toward the lamp opening, the protrusion and the inturned corner being positioned relative to each other where the inturned corner will snap over the rim and engage one side of the rim with the protrusion engaging an opposite side of the rim as the connector is attached to the light to removably attach the connector to the light.

28. The cover assembly of claim 27, wherein:

the projecting rim is formed integral with the socket.

29. The cover assembly of claim 27, wherein:

the projecting rim is formed integral with the lamp.

* * * * *